US007658376B2

(12) United States Patent
Dobrindt

(10) Patent No.: US 7,658,376 B2
(45) Date of Patent: Feb. 9, 2010

(54) METHOD AND APPARATUS FOR DEPOSITING SHEET OF PAPER ONTO A STACK USING INTERMEDIATE TRANSPORT MEMBER

(75) Inventor: Dirk Dobrindt, Klausdorf/Schwentine (DE)

(73) Assignee: Eastman Kodak Company, Rochester, NY (US)

( * ) Notice: Subject to any disclaimer, the term of this patent is extended or adjusted under 35 U.S.C. 154(b) by 395 days.

(21) Appl. No.: 10/569,769

(22) PCT Filed: Aug. 24, 2004

(86) PCT No.: PCT/US2004/027503

§ 371 (c)(1),
(2), (4) Date: Nov. 13, 2006

(87) PCT Pub. No.: WO2005/023691

PCT Pub. Date: Mar. 17, 2005

(65) Prior Publication Data

US 2007/0114718 A1 May 24, 2007

(30) Foreign Application Priority Data

Aug. 29, 2003 (DE) ..... 103 39 885

(51) Int. Cl.
*B65H 29/00* (2006.01)

(52) U.S. Cl. ..... 271/187; 271/315

(58) Field of Classification Search ..... 271/178, 271/187, 315

See application file for complete search history.

(56) References Cited

U.S. PATENT DOCUMENTS

| | | | | |
|---|---|---|---|---|
| 4,629,174 | A | 12/1986 | Wakisaka et al. | 271/186 |
| 5,409,201 | A * | 4/1995 | Kramer | 270/58.13 |
| 5,518,230 | A * | 5/1996 | Scarlata et al. | 271/186 |
| 2004/0256797 | A1 * | 12/2004 | Dobrindt | 271/315 |

FOREIGN PATENT DOCUMENTS

| | | |
|---|---|---|
| DE | 2 309 075 | 8/1974 |
| JP | 61291363 | 12/1986 |

* cited by examiner

*Primary Examiner*—Patrick H Mackey
*Assistant Examiner*—Gerald W McClain
(74) *Attorney, Agent, or Firm*—Donna P. Suchy

(57) ABSTRACT

Depositing a sheet of paper onto a stack of sheets of paper, preferably for use in a printing press, where the sheet to be deposited is grasped by at least one rotationally drivable sheet conveyor member with the front edge of the sheet fed into a receptacle, and the sheet's front edge is released from the receptacle of the rotating sheet conveyor member prior to depositing of the sheet onto the stack of sheets, and instead, it is deposited into a receptacle of an intermediate transport member where it is further released for depositing the sheet onto the stack of sheets.

9 Claims, 2 Drawing Sheets

METHOD AND APPARATUS FOR DEPOSITING SHEET OF PAPER ONTO A STACK USING INTERMEDIATE TRANSPORT MEMBER

FIELD OF THE INVENTION

The invention relates to depositing a sheet of paper onto a stack of sheets, preferably for use in a printing press, particularly an electrographically operating press, where the sheet to be deposited is grasped by at least one rotationally drivable sheet conveyor member with the front edge of the sheet fed into a receptacle, and to deposit on the stack of sheets, the sheets' front edge is released from a receptacle, preferably through the use of a stop, particularly, a stack edge.

BACKGROUND OF THE INVENTION

Rotational sheet conveyors for feeding sheets into a receptacle for stacking are identified in DE-A-23 09 075.

During the course of stack formation, particularly in electrographically produced prints where the toner is applied on the print material sheet, a print image that is not uniformly distributed on the sheet, in addition to repetition, can result in the formation of a skewed or uneven stack. As a result, sheet depositing with a rotating sheet conveyor member may be impaired or at a minimum, imprecise sheet depositing may occur.

SUMMARY OF THE INVENTION

Therefore, the underlying objective of the invention is to carry out a controlled depositing of the sheet of paper onto the stack of sheets. According to the invention, this objective is achieved by causing the sheet's front edge to be released from the receptacle of the rotating sheet conveyor member prior to the depositing of the sheet onto the stack of sheets, and instead, it is deposited into a receptacle of an intermediate transport member, where it is further released for depositing onto the stack of sheets.

An intermediate transport member is therefore beneficially provided, according to the invention that is particularly suitable for controlled depositing. The intermediate transport member with a receptacle for the deposit of the front edge of the sheet of paper is arranged so that the sheet's front edge can be passed out of the receptacle of the sheet conveyor member into the receptacle of the intermediate transport member, preferably through the rotation of the sheet conveyor member.

There is preferably also a stop, particularly, a stack edge, with respect to which the intermediate member is movable relative to a sliding out of the sheet front edge out of its receptacle. Preferably, with the mobility of the intermediate transport member, no separate drive is provided that would require coordination with the drive or with the rotary position of the sheet conveyor member. Instead, a beneficial automatic control of the movement processes results if the intermediate transport member is coupled with the rotationally drivable sheet conveyor member for mobility.

Here, the timing of the processes and movement directions can be easily mechanically coordinated with each another. For coupling and control of the movement of the intermediate transport member, at least one curved path that rotates with the sheet conveyor member is provided, preferably a cam plate.

A more preferable arrangement of the apparatus, according to the invention, can be provided so that the intermediate transport member is suspended movably by a lever assembly with, preferably at least one of the lever arms of the lever assembly, being supported movably on at least one curved path, at least indirectly via an intermediate element. A particularly favorable arrangement is present, in that the lever assembly includes an essentially horizontally oriented level arm and an essentially vertically oriented level arm that are connected to each other with play remaining, and a separate curved path is provided in each case to allow for their movement processes.

To assure a continuous secure abutment of the elements on the curved paths and/or to assure automatic return of the elements to their idle or starting positions, the apparatus is preferably configured so that the intermediate transport member or coupling elements provided are spring-fitted.

A more secure, more reliable, controlled method for receiving and depositing the sheet is achieved by causing the receptacle of the intermediate transport member to be formed in the shape of a gripper mouth instead of, for example, in the shape of a simple slot. Such a gripper mouth formation can be achieved through use of simple clamp legs that are formed, for example, as leaf springs.

The invention, and its objects and advantages, will become more apparent in the detailed description of the preferred embodiment presented below.

BRIEF DESCRIPTION OF THE DRAWINGS

An exemplary embodiment of the invention from which further inventive features can ensue (but to which the invention is not limited in its scope), is shown in the drawing. The schematic figures are as follows.

DETAILED DESCRIPTION OF THE INVENTION

Figure 1:
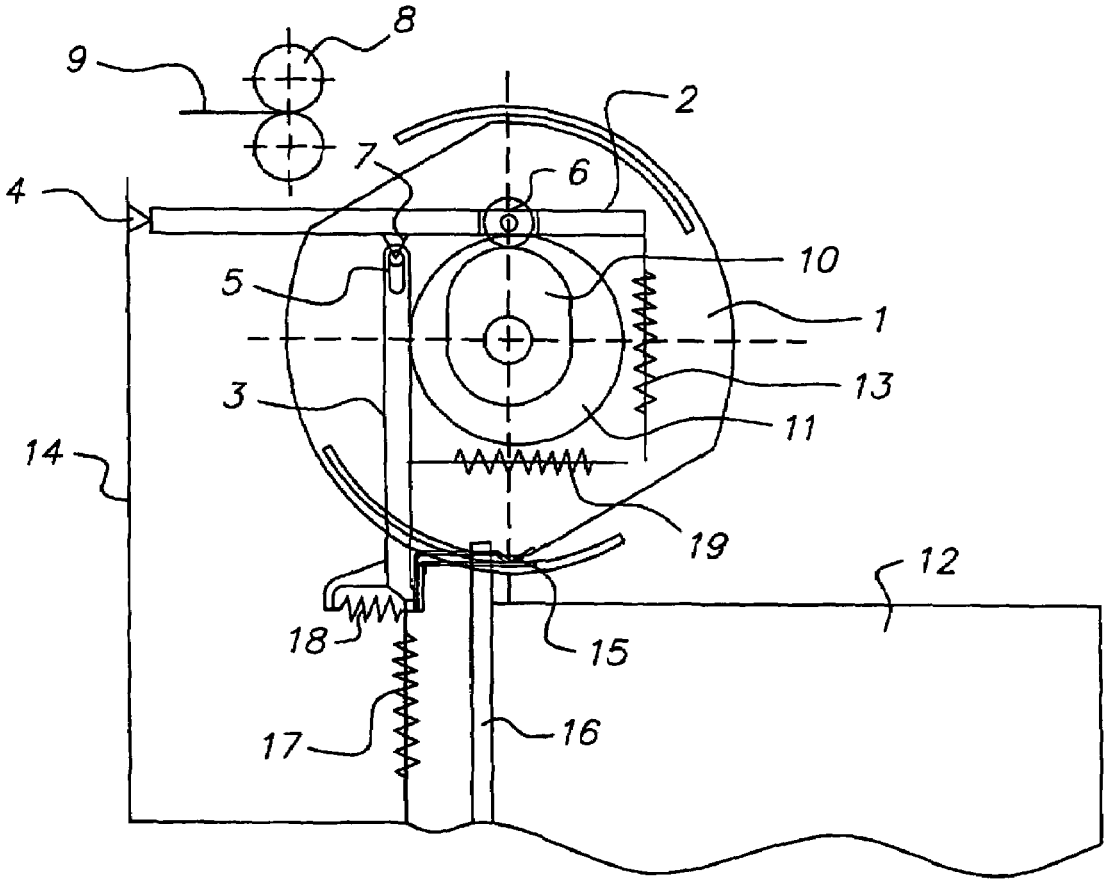
FIG. 1 is an apparatus according to the invention in a lateral view.

Referring now to the accompanying drawings, FIG. 1 shows an apparatus according to the invention, schematically in a lateral view. The apparatus includes a rotationally drivable sheet conveyor member 1 that has two slot-shaped receptacles for sheet's front edges that are arranged in a manner where they are diametrically opposed to one another. Coaxially arranged cam plates 10, 11 rotate with the sheet conveyor member.

Moreover, the apparatus includes the lever arm assembly with a horizontal lever arm 2 and a vertical lever arm 3. The vertical lever arm 3 is suspended in a movably swinging manner on the horizontal lever arm 2. This occurs through the use of a pivot 7 that is guided in a longitudinal hole 5 that offers some play of the lever arm 3. The lever arm 2 is controllably supported on the cam plate 10 with a ball bearing 6, and is rotatably attached at a pivot 4. The lever arm 3 controllably abuts onto the cam plate 11. Springs 13 and 19 ensure the secure respective abutments of the lever arms. The system is arranged on a mount 14.

A sheet 9, to be deposited on a stack 12, arrives from a path for print material and reaches the last transport rollers 8 of the path. These transport rollers 8 pass the sheet 9 to the sheet conveyor member 1 by pushing it into a free slot of the sheet conveyor member 1. However, the sheet 9 is not released directly onto the stack 12 from the sheet conveyor member 1. At the lower end of the vertical lever arm 3, instead, there is a gripper mouth 15 that acts as an intermediate transport mechanism for the sheet 9. The sheet 9 is passed into this gripper mouth 15 through the rotation of the sheet conveyor member 1. Due to the eccentricity of the cam plate 11, during further rotation of the sheet conveyor member, the vertical lever arm 3 endures a pendulum swing (to the left, in the representation in the drawing) about the pivot 7. In this manner, the gripper mouth 15 moves relatively through a stack edge 16, where the sheet is slid out of the gripper mouth 15, and thereafter it falls onto the stack 12.

The pendulum movement of the vertical lever arm 3 occurs against the spring force of a spring 17 that vertically pulls the lever arm 3 in the play 5 downward, and adapts to the stack height. Moreover, the gripper mouth 15 is not rigidly attached to the vertical lever arm 3 but rather, is secured to it only with a spring 18, so that the gripper mouth 15 participates in the previously mentioned movement to the left but does not need to change its angular position with the lever arm 3; but instead, it can keep its horizontal orientation. This prevents the gripper mouth from getting jammed in its relative movement on the top side of the stack 12, with respect to the stack edge 16, since it does not require non-positively any swiveling path.

Figure 2:
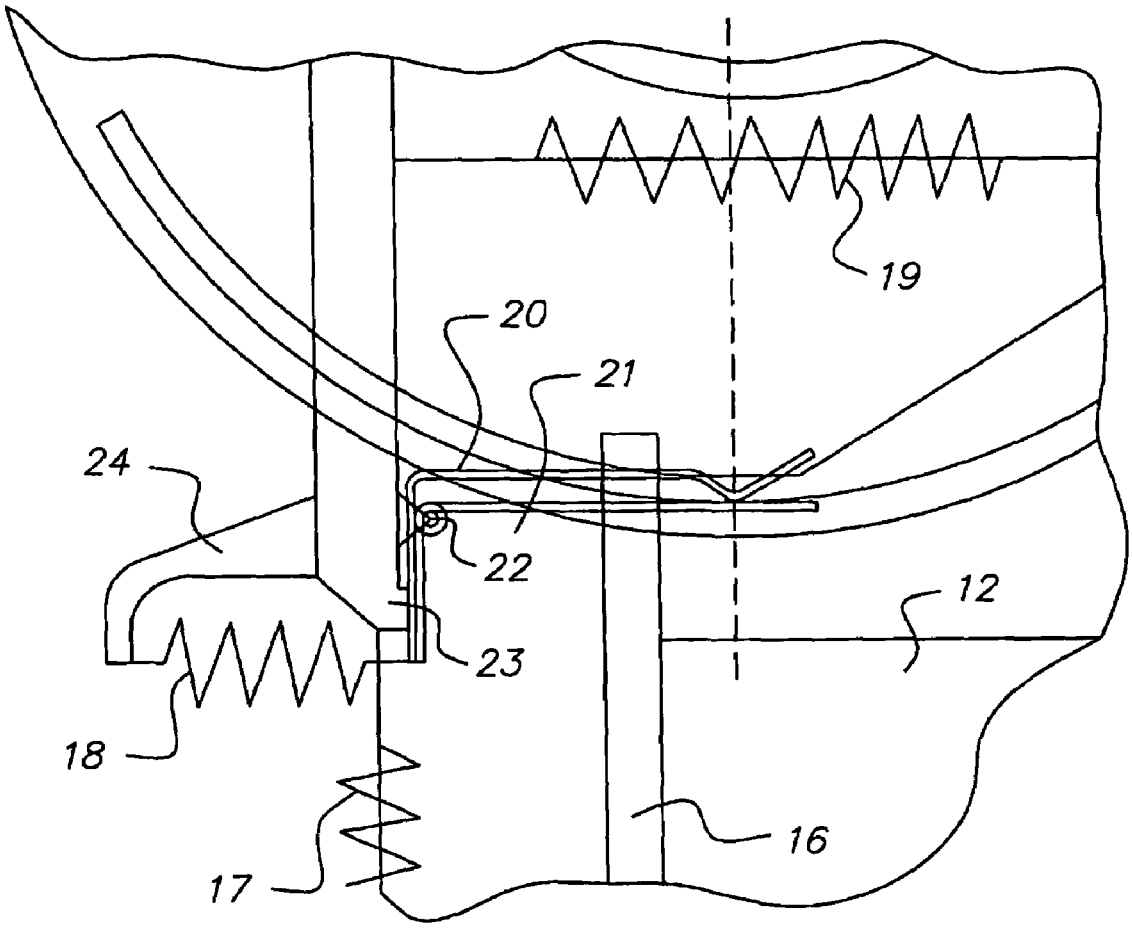
FIG. 2 is an enlarged detailed view from FIG. 1.

FIG. 2 shows a detailed view of FIG. 1. Identical components are designated with the same reference numbers as in FIG. 1. The gripper mouth 15 has two clamping elements 20, 21. They are coupled jointly via a pivot 22 on the vertical lever arm 3, and are swiveled and pulled by the spring 18 against a stop 23 of the lever arm 3. The spring 18 is attached on its end, opposite the gripper mouth on an extension 24 of the lever arm 3.

The movement process of the apparatus can be briefly described as follows:

During rotation of the sheet conveyor member 1, the installed cam plates 10, 11 participate in the movement. If a sheet 9, to be deposited, was conveyed via the sheet conveyor member 1 against the stack edge 16, then this sheet 9 has simultaneously threaded into the gripper mouth 15. After the sheet conveyor member 1 is rotated out of the region of the sheet 9, the gripper mouth 15 is lowered over the cam plate 10. Finally, the gripper mouth 15 is placed on the stack 12.

In order to compensate for differences in height in the stack 12, an elongated hole guide 5 is located on the vertical lever arm 3. The tension spring 17 ensures that the gripper mouth 15 is actually resting on the stack 12. In the next step in the representation, the gripper mouth 15 must now proceed through the stack edge 16, while being moved away to the left. This is accomplished via the cam plate 11. The cam plate 11 deflects the vertical lever arm 3 over the pivot 7, to the left. To prevent the gripper mouth 15 from jamming with the stack 12 during this rotational movement, the gripper mouth is installed in a spring-fitted manner on the vertical lever arm 3. As a consequence, the gripper mouth 15 remains horizontally oriented during the lateral swinging. The sheet 9 can thus be concisely released over the stack 12.

The benefit with this additional device, on the sheet conveyor member, is that the sheet is still reliably deposited on a stack, even in the case of a skewed stack surface. In the included representations, only one sheet conveyor member is shown with the corresponding mechanics. In the total unit of an extension, however, there are preferably, two sheet conveyor members with the corresponding mechanics. If a stack has become oriented at a different height below the two sheet conveyor members, the two-gripper systems compensate for the unevennesses, independently of each other.

The stack height differences arise due to a one-sided print image, for example. Gradually, a skewed stack is formed, corresponding to a one-sided toner layer, for example.

The invention claimed is:

1. A method for depositing a sheet of paper onto a stack of sheets of paper, for use in a printing press, where said sheet to be deposited is grasped by at least one rotationally drivable sheet conveyor member with said front edge of said sheet fed into a receptacle, and to deposit said sheet on said stack of sheets, said sheet's front edge is released from a receptacle, through use of a stop, by a stack edge, characterized by releasing said sheet's front edge from said receptacle of said rotating sheet conveyor member, prior to said depositing of said sheet onto said stack, and moving said sheet's front edge into a receptacle of a gripper mouth that acts as an intermediate transport in a horizontal direction relatively through a stack edge where it is further released for depositing said sheet onto said stack of sheets.

2. An apparatus for depositing a sheet of paper on a stack of sheets of paper, for use in a printing press, including at least one rotationally drivable sheet conveyor member with at least one receptacle where said front edge of said sheet is to be deposited, characterized by an intermediate transport member with a receptacle where said front edge of said sheet is to be deposited that is arranged so that said sheet's front edge can be passed out of said receptacle of said at least one rotationally drivable sheet conveyor member into said receptacle of said intermediate transport member through said rotation of said rotationally drivable sheet conveyor member, characterized by a stop, which is movable in a horizontal direction by said intermediate transport member through a sliding of said sheet's front edge out of the receptacle of a gripper mouth that acts as the intermediate transport member.

3. The apparatus according to claim 2, characterized by said receptacle of said intermediate transport member being formed as a gripper mouth that acts as an intermediate transport member.

4. The apparatus according to claim 2, characterized by said intermediate transport member being coupled with said rotationally drivable sheet conveyor member for mobility.

5. The apparatus according to claim 4, characterized by at least one cam plate that rotates along with said sheet conveyor member, being provided for coupling and control of said movement of said intermediate transport member.

6. The apparatus according to claim 5, characterized by said intermediate transport member being suspended movably by a lever assembly.

7. The apparatus according to claim 6, characterized by at least one lever arm of said lever assembly is supported movably on at least one cam plate at least indirectly via an intermediate element.

8. The apparatus according to claim 6, characterized by said lever assembly including an horizontally oriented level arm and an vertically oriented level arm that are connected to each other with play remaining, and a separate cam plate is provided to allow their movement processes.

9. The apparatus according to claim 5, characterized by the intermediate transport member coupling elements are spring-fitted.

* * * * *